United States Patent [19]

Walter

[11] 4,310,102

[45] Jan. 12, 1982

[54] CLOSURE FOR PRESSURE CONTAINER

[75] Inventor: John Walter, Evergreen Park, Ill.

[73] Assignee: The Continental Group, Inc., Stamford, Conn.

[21] Appl. No.: 892,525

[22] Filed: Apr. 3, 1978

[51] Int. Cl.[3] ..... B65D 41/04

[52] U.S. Cl. ..... 220/288; 220/94 R; 220/366; 220/270; 215/250; 215/253; 215/330; 222/153; 222/570

[58] Field of Search ..... 220/235, 258, 94 R, 220/288, 366, 214, 265, 266, 270; 215/216, 256, 250, 253, 254, 356, 360, 330; 222/153, 541, 537, 541, 568, 570

[56] References Cited

U.S. PATENT DOCUMENTS

| | | | |
|---|---|---|---|
| 2,784,865 | 3/1957 | Rieke | 220/366 X |
| 3,167,202 | 1/1965 | tolciss | 220/288 X |
| 3,307,752 | 3/1967 | Anderson | 222/570 X |
| 3,902,621 | 9/1975 | Hidding | 215/254 X |
| 3,905,502 | 9/1975 | Wassilieff | 215/250 |

*Primary Examiner*—George T. Hall
*Attorney, Agent, or Firm*—John J. Kowalik; Joseph E. Kerwin; Charles E. Brown

[57] ABSTRACT

A removable closure for a pressure container having an opening with a peripheral bead into which there is inserted a threaded neck member, the neck member being formed of a resilient plastic material adapted to expand and contract and having an interlocking engagement with the bead. The neck is provided with a radially extending handle portion by means of which the container is adapted to be carried and which also serves to prevent rotation of the neck member upon the application and threading of a cap to the neck member, the cap having a plug portion which enters into the opening in the neck member and being tapered wedges into the neck member and spreads the portion of the neck member which is in radial alignment with the bead portion, thus tightly forcing such portion against the bead to provide a high pressure seal. The plug portion is provided with pressure relief grooves at its inner end extending axially of the plug such that as the cap is being unscrewed from the neck portion, the grooves are positioned to communicate the interior of the container with a space between the interior of the neck and the plug outwardly of the interlocking portion so that the excess pressure can bleed off to the atmosphere about the threads. The invention also comprises novel pilferproof mechanism which has to be broken away from the cap in order to unscrew the cap and therefore readily is indicative of tampering.

11 Claims, 11 Drawing Figures

CLOSURE FOR PRESSURE CONTAINER

DISCUSSION OF THE PRIOR ART

Various devices have been provided for closing containers. These devices in general consist of a snap-in member and a cap. The snap-in member generally is made of rather rigid material so that when assembled with the openings in the container it will resist turning when the closure cap is applied thereto. Closure caps have been known to provide a wedge type plug which extends into the opening in the neck fitting but have been difficult to close because of the nature of the material from which the neck member is formed. Difficulty has also been experienced in balancing the flexibility of the plug and the neck member not only for preventing the neck member from being pressured out of the container when the cap is slightly unthreaded, but also to cause the neck member to expand sufficiently so as to tightly seal against the margin of the opening in the container which normally is formed of metal such as steel, aluminum or the like. Attention is directed to U.S. Pat. Nos. 3,552,607 and 3,272,405 and the art cited therein.

SUMMARY OF THE INVENTION

This invention is directed to a novel closure for a preferably metallic container wherein the closure comprises two pieces including a neck member or pour spout which is adapted to be snapped into the opening of the container and a cap member which is adapted to be threaded onto the neck member, the neck member being provided with a handle portion which may be grasped by the person applying and removing the cap to prevent rotation of the neck member upon threading or unthreading of the cap. Thus the neck member may be made of relatively soft material such as polyethylene or the like so that it may readily expand and contract with respect to the periphery of the opening on the application and removal of the cap to the neck member, said cap member including a tapered plug which fits into the bore of the neck member and which upon threading of the cap onto the neck member causes the plug to wedge into the neck member and to expand portions of the neck member which are formed to interlock with the edge portions of the wall of the container about the periphery of the opening.

A feature of the invention is the provision of novel bleed slots of limited extent elongated axially of the plug and extending from the inner end of the plug to an area intermediate the ends of the plug, these slots being arranged to communicate with a clearance or passage provided between the plug and the bore of the neck portion upon partial unthreading of the cap whereby high pressure gases are permitted to escape upwardly and through the interengaging threads between the cap and the threaded neck portion.

Another object of the invention is to provide novel pilfer-proof means comprising a series of detent teeth disposed about the base of the threaded portion of the neck, said teeth being adapted to engage a mating dog or catch formed of the same material as the plastic cap but being attached thereto by a tearable connection which allows the catch to swing and pivot over the teeth during the application of the cap to the neck portion but which prevents the unscrewing of the cap without destruction of the catch, that is, by tearing it off from the cap, thus providing a visual indicia of tampering.

These and other objects and advantages adherent in the invention will become more apparent from the specification and the drawings wherein.

Figure 1:
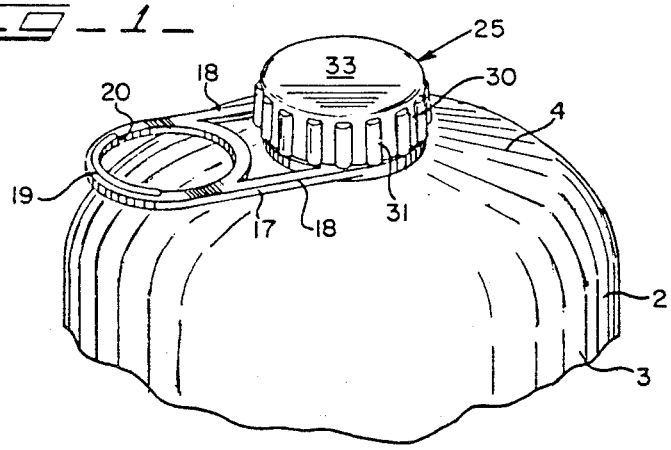
FIG. 1 is a fragmentary perspective view illustrating a container with the novel closure applied thereto.
Figure 2:
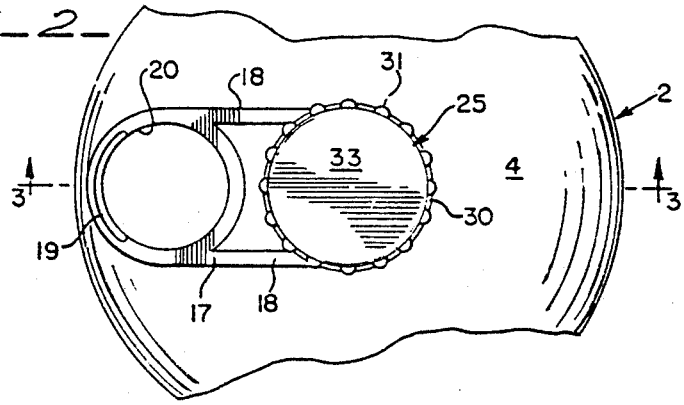
FIG. 2 is a top plan view of the structure shown in FIG. 1.
Figure 3:
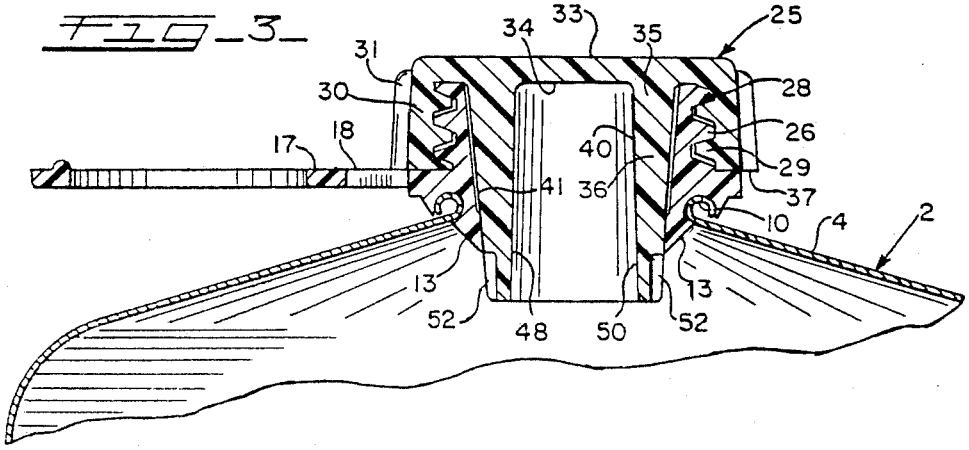
FIG. 3 is an enlarged cross-sectional view taken substantially on the line 3—3 of FIG. 2.

Describing the invention in detail, there is shown a container which is designated 2 which is preferably of metal, but which may be of any suitable plastic. The container comprises a body portion 3 and an upper dome portion 4 providing a wall which has a centrally located opening 6 bordered by an outturned annular angular curl 7.

The circular opening 7 admits therein the inner end portion 8 of a neck member or pour spout generally designated 9. The inner end portion comprises an annular external groove 10 which conforms to the shape of the bead 7 which is generally cylindrical in cross-section as well seen in the drawings. The groove intervenes between inner and outer flanges 11, 12 which are formed about the external side of the inner end portion 8 of the neck member 9.

Figures 4, 5, 6:
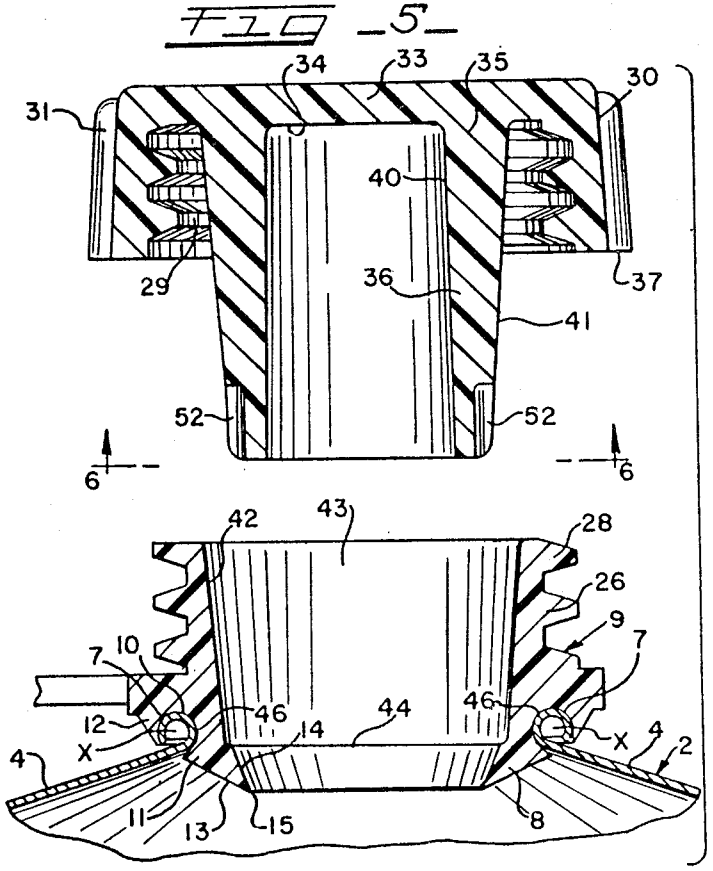
FIG. 4 is a view comparable to FIG. 3 but on a further enlarged scale.
FIG. 5 is an exploded view of the structure shown in FIG. 4 illustrating the parts in open position.
FIG. 6 is a fragmentary bottom view of the cap taken on line 6—6 of FIG. 5.

As best seen in FIG. 5, the flange portion 11 is in the shape of a truncated cone, that is, generally frusto-conical and has such frusto-conical outer periphery 13 and also a frusto-conical inner periphery 14 in its relaxed position. As best seen in FIG. 5, the angle of the surface 13 is much greater than the angularity of the surface 14 and thus the surfaces 13 and 14 meet in a sharp apical edge 15 at the inner end of the neck member. The conical-shaped outer surface 15 and the arrangement of the surfaces 13 and 14 permit the reduction of the quantity of material toward the inner end of the neck member and thus enhances the flexibility of the inner end portion and thus permits the inner end to be forceably inserted into the opening 7 by expanding the inner end portion.

Figure 10:
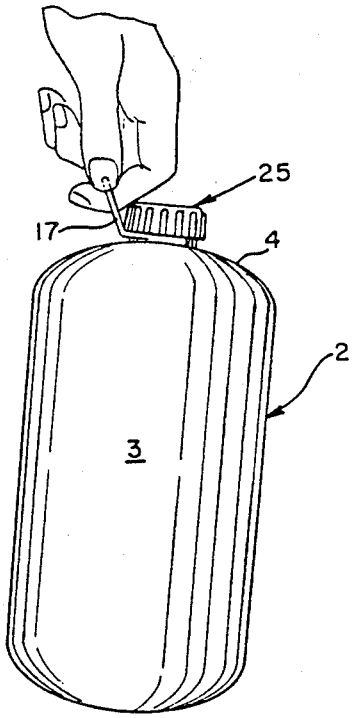
FIG. 10 is a side elevational view of the container and closure shown in carrying position.
Figure 11:
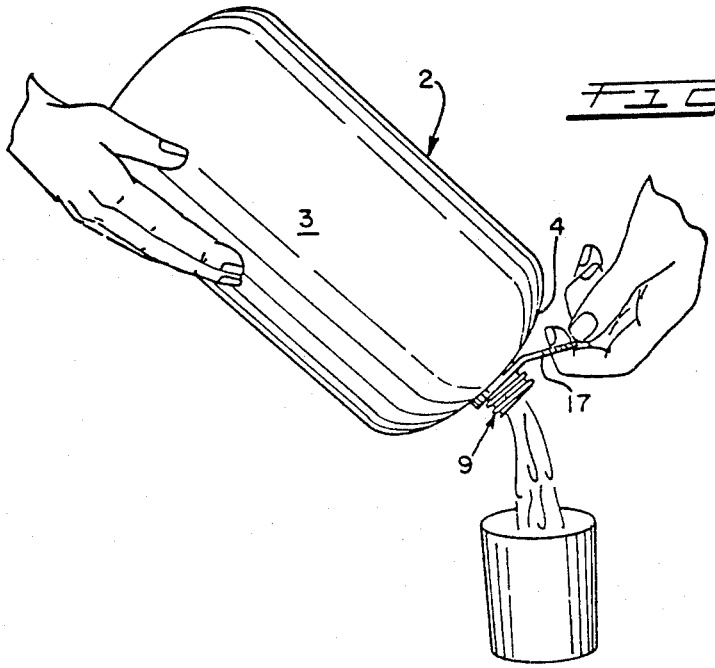
FIG. 11 shows the container in pouring position.

It will be seen, on the other hand, that the flange portion 12 is relatively thick and has connected thereto a radially outwardly extending skeletal handle element 17 comprising a pair of laterally spaced legs 18, 18 which at their inner ends are intergrally united with the flange portion 12 and at their outer ends are integrally united with a ring portion 19 having a finger hole 20 adapted for the user to insert his or her finger therethrough when functioning as an attachment to the container for carrying the same as seen in FIG. 10 or for holding the container conveniently as seen in FIG. 11 for pouring.

The handle 17 of the invention constitutes an important feature in that it permits the making of the neck portion as well as the inner end portion 8 relatively flexible so that after the inner end portion is easily snapped into the opening in the container, it is prevented from rotating by the user grasping the handle portion 17, to facilitate application of the cap generally designated 25 to the externally threaded upper end portion 26 of the neck member 9. The neck member is provided with external threads 28 which mate with complementary threads 29 on the internal side of a depending skirt 30 on the cap.

The cap 25 has an external ribbed periphery 31. The skirt joins at its upper end with an end wall 33 which on its internal or bottom side 34 is integrally formed with the upper end 35 of a plug 36 which depends below the lower edge 37 of the skirt. The plug preferably is hollow and has a cylindrical internal bore 40 and a frusto-conical exterior surface 41 and that the angle of the surface 41 is slightly less than the angle of the upper bore surface 42 of the neck portion 9 which has a bore generally designated 43 extending from one end to the other thereof. The bore 40 forms a passageway for the contents from the interior of the container to the exterior. It will be noted that the lower interior bore surface 14 has a materially sharper angle than the surface 42 and that the surface 14 terminates at its upper end 44 below the center plane X—X that passes radially through the center of the bead 7. Plug taper 41 is at constant angle from top to bottom and upon the cap being screwed onto the threads on the portion, the lower end of the plug becomes wedged into the lower end bore portion, 48 defined by the surface 14, and spreads the narrow lower end portion 8 of the neck causing the flanges 11 and 12 to tightly clampingly engage the surface 46 of the bead 7 of the container.

It will be noted that as the cap is being threaded into the neck portion, with coincident radial outward expansion of the portion 11, the neck portion is prevented from rotating by the user holding onto the handle 17. The wedging effect of the plug with the lower portion 11 effects a tight seal therebetween which is augmented by the pressure of the gasses within the container acting against the surface 13 tending to effect a sphincteral grip upon the inner end portion of the plug 36 and also the pressure acting against the surface 48 defining the bore 40, the pressure on the surface 48 tending to expand the lower end portion 50 of the plug 36. It will be appreciated that surface 48 and the surface 41 converge toward the lower end of the plug and therefore the plug wall becomes thinner gradually as it approaches the inner end of the plug therefore enhancing its flexibility, it being understood that the plug as well as the cap is formed of thermoplastic material preferably such as polyethylene. Although polyethylene has been chosen for illustrative purposes as a material for both the neck portion as well as the cap, any other similar material that has the preferable resilient characteristics is also contemplated for use with this invention.

Figure 7:
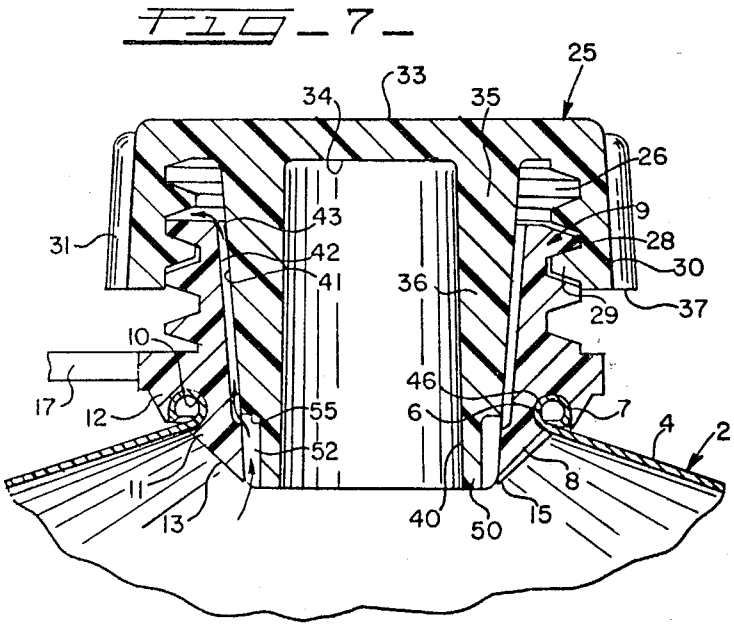
FIG. 7 is a cross-sectional view similar to FIG.3 on an enlarged scale illustrating the container partially open.

It will be apparent that in the closed position of the container, the plug has its innermost end portion 50 extending beneath the apical edge 15 of the flange portion 11 and that there are provided a plurality, preferably two, axially extended slots 52, 52 on the exterior side of the plug, said slots having inner terminal ends 53, 53 extending to the inner end 54 of the plug and having outer ends 55 extending to slightly below the apical edge 15. The function of these slots 52, 52 is to relieve the pressure within the container at a time when the cap is partially unscrewed whereat the upper ends 55 of the slots 52 communicate with the lower end of a diametrical clearance or passage 43 as seen in FIG. 7 so that the excess pressure can bleed off to the atmosphere from the interior of the container through the slots and passage and between the threads of the neck and the cap. The location of these slots and the extent thereof axially of the plug is so chosen that the inner end portion 50 of the cap is below the curl 7 whereby the inner end portion 8 is prevented from collapsing innerwardly and being forced out of the container.

Figure 8:
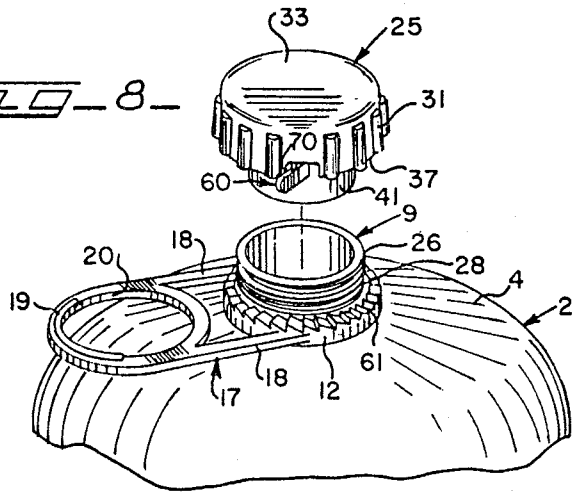
FIG. 8 is a perspective view showing the cap separated from the container.
Figure 9:
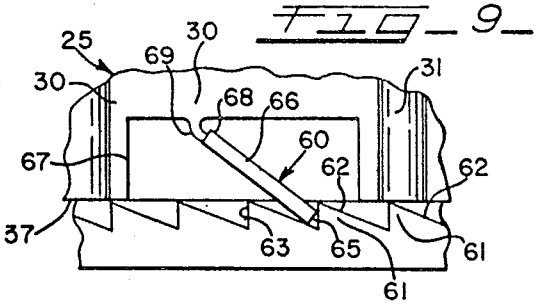
FIG. 9 is an enlarged fragmentary, side elevational view of the anti-pilfer mechanism.

The cap assembly is provided with an anti-tamper mechanism generally designated 60 in FIGS. 8 and 9 which comprises a series of teeth or detents 61 facing upwardly and formed on the flange 12 at the lower end of the threaded neck portion 28. These teeth are angled in a clockwise direction as seen from the top so as to provide slide ramps 62 and axially extending locking edges 63. The teeth 61 are engaged by the lower end 65 of a locking dog or catch 66 which extends edgewise laterally radially outwardly of the skirt 30 of the cap 25 through a notch 67 formed in the side or lower bottom portion of the skirt. The catch is connected at its upper end 68 to a frangible flexible tether 69 which is formed of the same material with the catch 60 as the cap 25.

It will be readily apparent that the catch is adapted to slide over the ramp surfaces 62 on the annular array of teeth 61 and prevent unscrewing of the cap which may be only accomplished by the user breaking off the catch 60 by wrenching on the laterally or radially outwardly projecting tab 70. Thus in order to open the container the user has to grasp or place his thumb under the tab 70 and by pressing upwardly break the tab off with the catch 60 thereby releasing the cap for unscrewing. Since the tab 70 is visible from the side of the cap, it is readily apparent when the tab has been broken off and any subsequent user is readily aware of the fact that the container has been tampered. After the tab is removed the user grasps the handle 17 and proceeds to rotate the cap which partially withdraws the plug 35 from the neck. Upon the plug being withdrawn sufficiently to communicate the grooves or notches 52 with the space 41, the user will normally hear a momentary hissing sound of the escaping pressurized gases. The user continues and completes unscrewing of the cap, and removing it from the neck whereupon the contents may be poured through the bore 43. The closing of the cap requires the user to grasp the handle 17, apply the cap and then thread it tightly until the inner end of the plug is positioned as shown in FIG. 4.

Thus it will be noted that the various features have been combined, particularly with respect to the aspect of providing a plug which not only is relatively easy to manufacture and to apply, but wherein the handle serves the function not only as a carrying member for the container but also to prevent rotation of the cap member. The novel construction of the plug as well as the neck portion, particularly in the region of the inner ends thereof, provides an effective seal between the neck portion and the container and between the cap and the neck portion. Furthermore, the arrangement of the venting notches and the functional relationships of the inner end portions and the interlocking portions is such that the cap is prevented from being forced out of the container by the high pressure within the container because the inner end is positively maintained in its spread out interlock condition against the inner side of the container at the time of release of the high pressure. The handle also serves to assist in holding the container in pour position as seen in FIG. 11 and as a carrier in FIG. 10.

Having described a preferred embodiment of the invention, it will now become apparent that various modifications thereof will be available to those skilled in the art which fall within the scope of the appended claims.

I claim:

1. A closure for a pour opening in a transaxially extending wall of a container comprising:

a flexible plastic neck member extending into the container transversely of said wall through said opening and having axially spaced inner and outer sealing means embracing said wall and abutting the inner and outer sides thereof about said opening, and a cap threaded onto said neck member and having plug means extending into a pouring bore in said neck member and having a wedge fit with a reduced portion of said member for expanding a contiguous portion of the same and also concurrently deflecting said sealing means into tight sealing engagement with the marginal edge of said wall defining said opening and said sealing means being formed and arranged to swing axially of said wall attendant to wedging of said plug means within said reduced portion of the neck member.

2. A closure for a pour opening in a wall of a container comprising:

a flexible plastic neck member extending into the container through said opening and having inner and outer sealing means embracing said wall about said opening, and a cap threaded onto said neck member and having plug means extending into a pouring bore in said neck member and having a wedge fit with a portion of said member for expanding a contiguous portion of the same and deflecting said sealing means into tight sealing engagement with said wall, and said bore having an outer end portion of a first diameter accommodating said plug means loosely therein and having an inner end portion of a diameter less than said inner end portion and being stretchable for stretch fit of the plug means therein and deformation of the sealing means within the container against the inner side of said container wall.

3. The invention according to claim 1 and said neck member comprising a handle for grasping by the user to prevent rotation of the neck member during threading of the cap onto said neck member.

4. The invention according to claim 3 and said handle extending radially outwardly of the neck member and having a finger hole therein to facilitate carrying of the container.

5. A closure for a pour opening in a wall of a container comprising:

a flexible plastic neck member extending into the container through said opening and having inner and outer sealing means embracing said wall about said opening, and a cap threaded onto said neck member and having plug means extending into a pouring bore in said neck member and having a wedge fit with a portion of said member for expanding a contiguous portion of the same and deflecting said sealing means into tight sealing engagement with said wall, and said neck member and plug means defining a vent space therebetween in the upper portion of the bore, and said plug means having an inner end with at least one peripheral vent slot extending from the inner end of said plug means and adapted upon partial unthreading of said cap to permit escape of high pressure gases from the container to the vent space and thence between the threaded cap and neck member while in wedge fitting relation with said portion of said member.

6. The invention according to claim 1 and said cap having a skirt telescoped over the outer end portion of the neck member in the closed position of said closure and said skirt and outer end portion of the neck member having mating threads, and cooperative tamperproof means on the skirt and neck member for preventing unthreading of the cap comprising a visually apparent element breakable upon unthreading of the cap.

7. The invention according to claim 6 and said element comprising a dog removably attached to said skirt, and detent means on the neck member cooperative with said dog.

8. A closure for an opening in a wall of a container comprising a flexible plastic neck member having a tapered inner end portion insertable through said opening and at said end portion having inner and outer radial flange portions defining a groove therebetween for receiving a marginal portion of the wall circumjacent said opening, said neck member having a bore of predetermined diameter beyond said inner end portion and being constricted at said inner end portion, and the bore surface of said constricted portion thereof and the exterior surface of the end portion defining a progressively tapered section adaptable for tight insertion of a closure plug therein and expansion of said inner flange portion and deflection radially and axially thereof with respect to said neck member.

9. The invention according to claim 8 and a combination carrying and anti-rotation handle member connected to said neck member.

10. The invention according to claim 9 and a cap having a closure plug insertable into said bore in the neck member and having an inner end portion dimensioned to stretch said inner flange portion, said inner end portion of the plug having vents therein communicating with the interior of the container in the closed position of the closure, said plug being partially withdrawable from said inner end portion of the neck member and said vents in such position communicating with both the interior of the container and exteriorly thereof, and while said inner flange portion is maintained in its expanded condition to prevent its being dislodged from the container by pressurized gases therein.

11. In a closure for a container having a threaded neck and a pour opening therein a cap having a top with an axially extending plug insertable into said opening and having a threaded skirt for threaded engagement with the threads on the neck, said opening and said plug having engaging surface means, and venting means included in at least one of said surface means formed and arranged to vent pressurized gases from the container upon said cap being less than entirely unthreaded from said neck to prevent the cap from being blown off.

* * * * *